United States Patent [19]

Lever et al.

[11] Patent Number: 4,519,182

[45] Date of Patent: May 28, 1985

[54] ARTICLE WRAPPER AND METHOD OF FORMING

[75] Inventors: John K. Lever, Redwood City; Angelo N. DiVecchio, Los Altos, both of Calif.

[73] Assignee: Certipak Corporation, Greenwich, Conn.

[21] Appl. No.: 450,522

[22] Filed: Dec. 17, 1982

[51] Int. Cl.[3] ..... B65D 5/04; B65B 11/00

[52] U.S. Cl. ..... 53/461; 53/398; 53/48; 53/466; 206/434; 229/40; 229/48 R

[58] Field of Search ..... 53/398, 461, 466, 48; 229/52 BC, 48 R, 40, 38, 35; 206/140, 194, 197, 434

[56] References Cited

U.S. PATENT DOCUMENTS

| | | | |
|---|---|---|---|
| 3,085,377 | 4/1963 | Ganz | 53/398 |
| 3,295,291 | 1/1967 | Wood | 53/398 |
| 3,456,420 | 7/1969 | Ganz | 53/398 |
| 3,474,590 | 10/1969 | Ganz | 53/398 |
| 3,541,757 | 11/1970 | Bertrand | 53/398 |
| 3,552,082 | 1/1971 | Howard | 53/398 |
| 3,750,363 | 8/1973 | Wood | 53/461 |
| 4,330,079 | 5/1982 | Wood | 229/40 |

*Primary Examiner*—W. D. Bray

*Attorney, Agent, or Firm*—King, Liles & Schickli

[57] ABSTRACT

An article wrapper for an article, or plurality of articles in at least one row, is formed from an elongated blank having a top panel, a pair of side panels connected to the top panel along fold lines, and a pair of bottom panels with each of the bottom panels connected to the adjacent side panels at two score lines. Compression tabs are positioned between the bottom score lines to allow tightening of the wrapper by squeeze guides. The bottom panels are arranged in overlapping relation and secured to each other by an adhesive, for example, after tightening the wrapper. The uppermost bottom score line adjacent each of the side panels enables a right angle corner to be formed at the bottom of each of the side panels so that each of the side panels presents an uninterrupted surface. The tabs are tucked under the bottom so as to be hidden from view.

8 Claims, 10 Drawing Figures

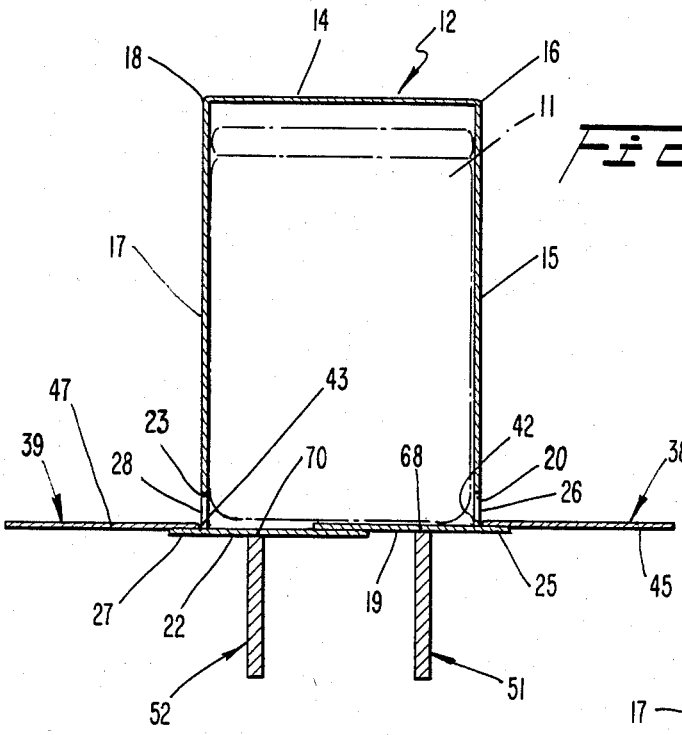
Fig. 7
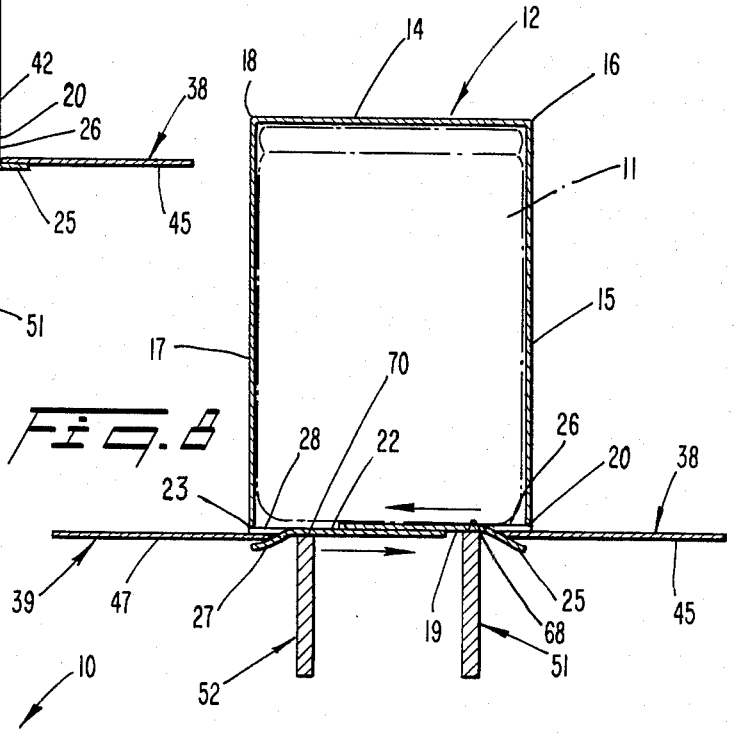
Fig. 8
Fig. 10
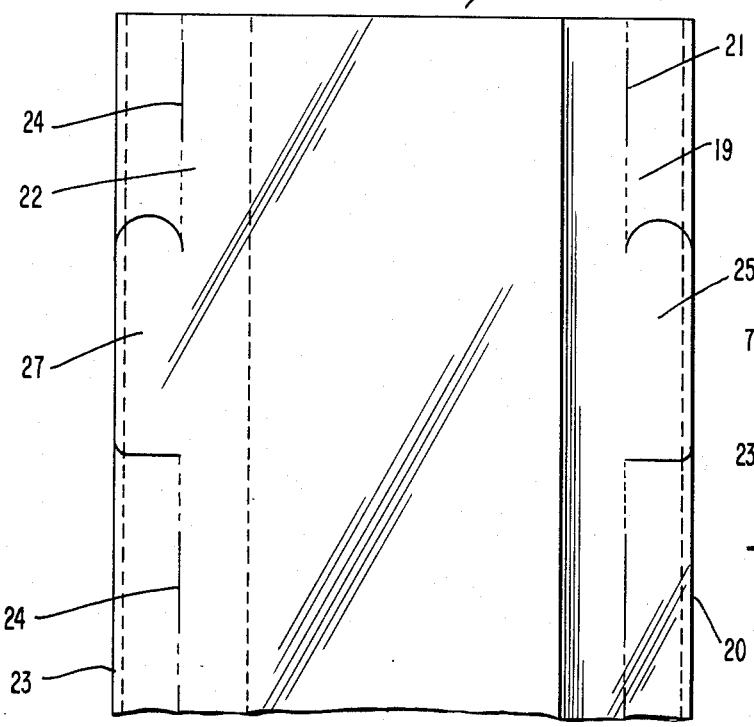
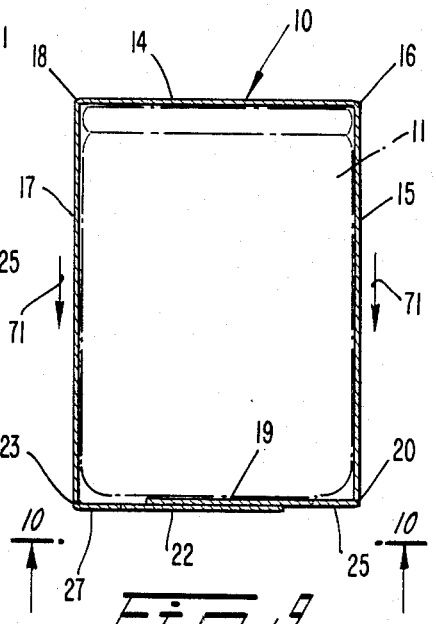
Fig. 9

ARTICLE WRAPPER AND METHOD OF FORMING

TECHNICAL FIELD

This invention relates to an article wrapper for at least one or a row of articles, and a method of forming the wrapper and, more particularly, to an article wrapper having uninterrupted side panels and hidden tabs for tightening the wrapper and a method of forming.

BACKGROUND ART

In each of U.S. Pat. No. 3,220,155 to Sherman, U.S. Pat. No. 3,456,420 to Ganz, U.S. Pat. No. 3,541,757 to Bertrand, and U.S. Pat. No. 4,330,079 to Wood, there is shown an article wrapper for one or more rows of articles. In this prior art, there are tabs protruding from each of the side panels so that the wrapper can be tightened during formation. The compression tabs, as called in the trade, are visible and interrupt the side panels making the package less desirable from an aesthetic point of view. The manufacturer of the goods being packaged usually spends substantial funds in multi-color printing on the paperboard and having uninterrupted side panels would thus be very desirable.

In addition, in some wrapper-type cartons a film is tightly wrapped around the article wrapper and with the prior art style, there is the possibility of the film being ruptured by the side protruding tabs. Even if a wraparound film is not utilized, the protruding tab also present the the possibility of engagement with an adjacent article wrapper when the article wrappers are stacked. Also, when the wrapper is directly resting on a display shelf, the tabs are likely to engage and hang on the front shelf edge, shelf dividers or other protrusions, making the packages difficult to pick up or shift. When the tabs are thus struck and mutilated, the packages become even less desirable from an appearance standpoint.

DISCLOSURE OF THE INVENTION

The article wrapper of the present invention is provided with compression tabs tucked, and thus hidden, under the bottom of the package. The sides of the wrapper are folded along the full length score line extending in the same plane as the bottom of the package.

The wrapper is formed by the method of the present invention so that any film wrapped around the article wrapper is not subject to being punctured. The article wrapper is successfully formed with the side panels being uninterrupted by openings, intermediate fold lines or tabs protruding therefrom.

The article wrapper of the present invention is easy to form from a blank even though the tabs are hidden in the bottom or closure panels of the wrapper. The static plows used in industry as a standard have been discovered to be well adapted for use in the improved method with a minor spacing adjustment.

Additionally, the absence of the tabs from the side panels enables close stacking of the article wrappers without the likelihood of one of the wrappers hanging up on another of the wrappers or on the shelf. Of perhaps most importance to the product manufacturer, a more aesthetic appearance of the article wrapper is obtained with the tabs being hidden from view, the tabs are fully tucked into the openings in the bottom panel, and thus are disposed in the plane of the bottom. This serves to not only hide the tabs but also fully closes the bottom of the wrapper for added protection.

Thus, an object of this invention is to provide a tightly wrapped wrapper having hidden tabs for a more aesthetically pleasing appearance.

Another object of this invention is to provide an article wrapper of the type described above having uninterrupted side panels and with the compression tabs fully tucked into the bottom.

A further object of this invention is to provide a method of forming an article wrapper having such hidden tabs and uninterrupted side panels.

Other objects of this invention will be readily perceived from the following description, claims, and drawings.

This invention specifically comprises an article wrapper for tightly wrapping one or a plurality of articles in at least one row including a top panel for engagement with a top portion of the article or articles, and a pair of uninterrupted side panels attached to opposide sides of the top panel and substantially perpendicular thereto. Each of the side panels has a separate bottom panel attached thereto and folded substantially perpendicular thereto. The bottom panels have an overlapping relation and are secured to each other to be retained in the overlapping relation. A pair of parallel score lines is provided between each of the bottom panels and the adjacent side panel with a plurality of tabs formed between the score lines. Each of the tabs has its base connected to the first score line farthest from the side panel. The fold between the bottom and side panels is made along the second score line aligned with the free edge of the tab. Thus, in the completed package, the tab and first score line are on the bottom so that the tabs are hidden.

This invention further relates to a method of forming an article wrapper from an elongated blank in which the article is wrapped around one or a plurality of articles in at least one row including forming the blank with a top panel, side panels connected to the opposite sides of the top panel, an upper fold line between each of the side panels and the top panel, a bottom panel connected to each of the side panels, and first and second score lines between each of the side panels and the connected bottom panel. As the articles are fed continuously along a conveyor, the blank is positioned substantially horizontally above the article(s) to be wrapped and the side panels are plowed down along the upper or top fold lines. Then, the bottom panels are lifted along the first (lowest) bottom fold line overlapping the bottom panels and allowing the tabs to extend outwardly ready to receive the tightening or squeeze rails. The tabs are engaged and the bottom panels shifted to the final position pulling the wrapper down tight around the article(s). The second (uppermost) fold line along the bottom now forms the lower edges of the wrapper. The squeeze rails release the wrapper allowing the tabs to fold down into the underlying apertures thus hiding the tabs and closing the bottom.

BRIEF DESCRIPTION OF THE DRAWINGS

The attached drawings illustrate a preferred embodiment of the invention, in which:

FIG. 7 is a sectional view of the apparatus of FIGS. 3 and 4 taken substantially along line 7—7 of FIG. 4 and showing further formation of the blank into the wrapper beyond that shown in FIG. 6;

FIG. 8 is a sectional view of the apparatus of FIGS. 3 and 4 taken substantially along line 8—8 of FIG. 4 and showing further formation of the blank into the wrapper beyond that of FIG. 7;

FIG. 9 is a sectional view, similar to FIG. 8, but showing the article wrapper in its final form in which a row of articles is tightly wrapped by the article wrapper; and FIG. 10 is an enlarged fragmentary bottom plan view of a portion of the article wrapper of FIG. 9 and taken substantially along line 10—10 of FIG. 9.

BEST MODE FOR CARRYING OUT THE INVENTION

Figure 3:
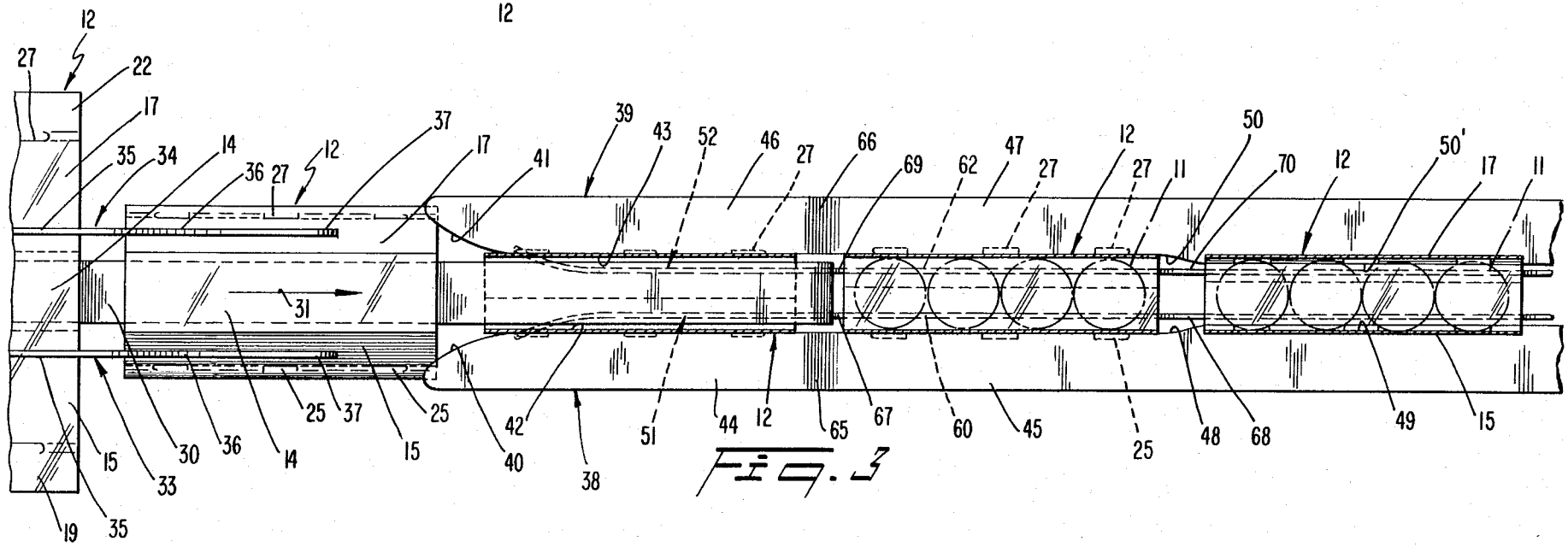
FIG. 3 is a top plan view of an apparatus illustrating the method for forming the blank into the article wrapper of the present invention.

Referring to the drawings and particularly FIG. 9, there is shown an article wrapper 10 for an article(s), such as a can 11, for example. As shown in FIG. 3, multiple cans may be arranged in a single row, in the wrapper 10; however articles could be arranged in two or more rows in accordance with the invention.

The article wrapper 10 is formed from an elongated blank 12 (see FIG. 1) of a suitable foldable sheet material, such as paperboard. The elongated blank 12 has a single top panel 14 to engage against the top of the can 11, as shown in FIG. 9, when the blank 12 has been formed into the article wrapper 10. The width of the top panel 14 depends upon the width of the can 11 and the number of rows.

A side panel 15 (see FIG. 1) is articulated or hingedly joined to the top panel 14 along a top score or fold line 16. A second side panel 17 is articulated or hingedly connected to the opposite side of the top panel 14 along a top fold line 18.

A bottom or closure panel 19 is articulated or hingedly connected to the side panel 15 through a pair of score lines 20 and 21. The side panel 17 has a bottom or closure panel 22 articulated or hingedly connected thereto through a pair of score lines 23 and 24.

A plurality of compression tabs 25 is disposed between the score lines 20 and 21. Each of the compression tabs 25 has its base formed along the lowest score line 21 integral with the bottom panel 19 and its free edge aligned with the uppermost bottom score line 20. The spaced compression tabs 25 occupy only a portion of a narrow bottom panel section 26 between the score lines 20 and 21.

A plurality of compression tabs 27 is disposed between the score lines 23 and 24. Each of the compression tabs 27 has its base formed along score line 24 integral with the bottom panel 22 and its free edge aligned with the other score line 23. The spaced compression tabs 27 occupy only a portion of a narrow bottom panel section 28 between the score lines 23 and 24.

The score lines 20 and 21, 23 and 24 are formed so that the score lines 21, 24 are weaker than the score lines 20, 23. Thus, during initial folding of the blank 12, the score lines 21, 24 break before the score lines 20, 23.

Figures 4, 5, 6:
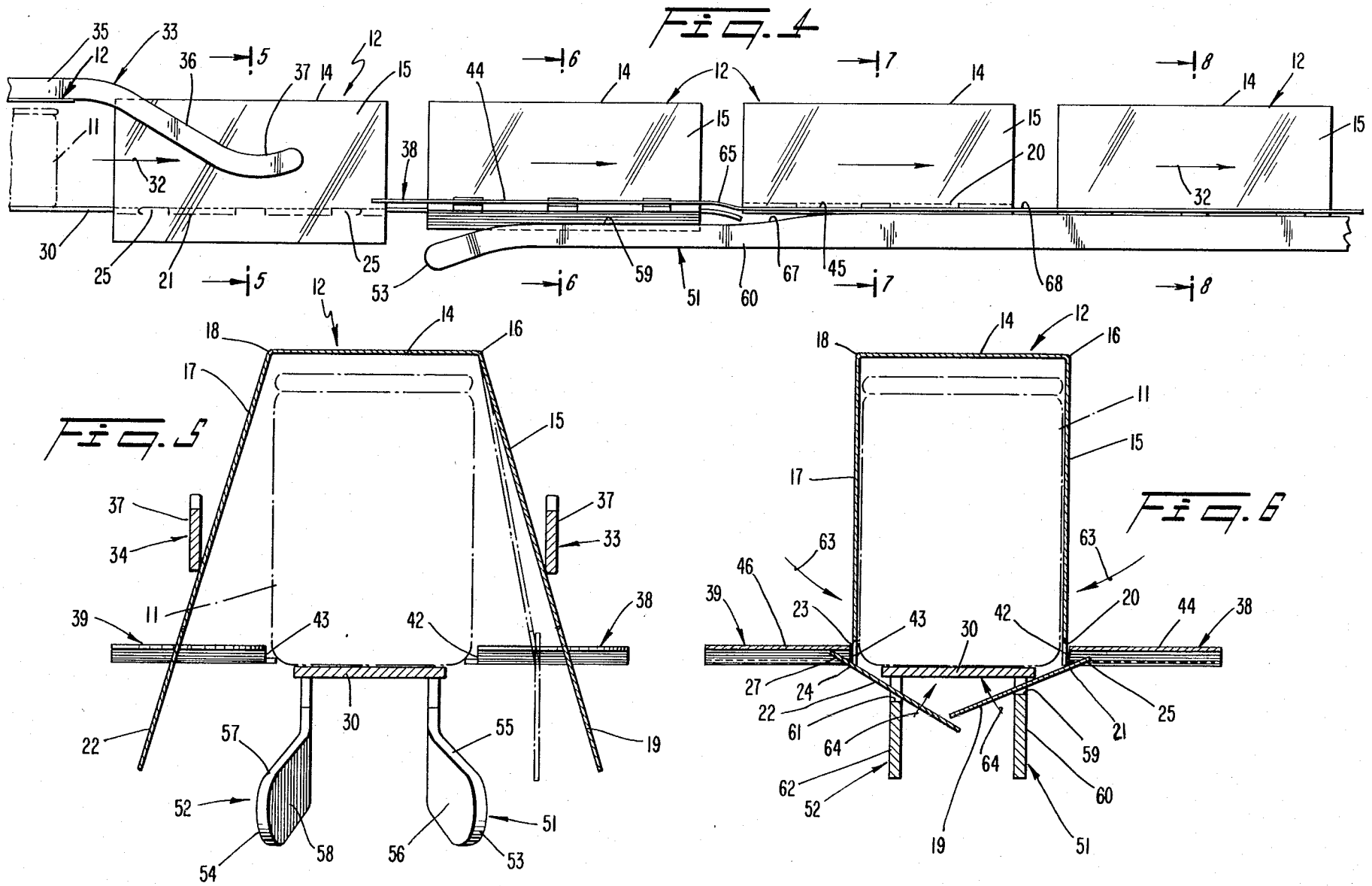
FIG. 4 is a side elevational view of the apparatus of FIG. 3.
FIG. 5 is a sectional view of the apparatus of FIGS. 3 and 4 taken substantially along the line 5—5 of FIG. 4 and showing initial formation of the blank into the wrapper.
FIG. 6 is a sectional view of the apparatus of FIGS. 3 and 4 taken substantially along line 6—6 of FIG. 4 and showing further formation of the blank into the wrapper beyond that shown in FIG. 5.

Referring to FIGS. 3 and 4, there is shown an apparatus for forming the elongated blank 12 into the article wrapper 10 of FIG. 9. As shown in FIGS. 3 and 4, a conveyor assembly 30 advances the cans 11 and the blank 12, which is disposed above the cans 11. The movement is in the longitudinal direction, shown by arrow 31 in FIG. 3 and arrows 32 in FIG. 4.

It should be understood that the elongated blank 12 and the cans 11 are advanced longitudinally in unison by any well known conveyor assembly. A suitable assembly is shown in the Bertrand U.S. Pat. No. 3,541,757 wherein a conveyor with lugs propels the articles and the blank in the desired longitudinal direction.

As the cans 11 are advanced by the conveyor 30, the elongated blank 12 moves beneath a pair of side plows 33 and 34. Each of the plows 33 and 34 has the same configuration. As shown in FIG. 4, the plow 33 has an upper horizontal portion 35, an inclined portion 36, and a lower terminal portion 37.

As the elongated blank 12 is advanced past the horizontal portion 35 of each of the plows 33 and 34 (which are spaced a greater distance apart than the width of the top panel 14, as shown in FIGS. 3 and 5) the inclined portion 36 and the terminal portion 37 of each of the plows 33 and 34 engages the side panels 15 and 17. This causes a downward bending of the side panel 15 about the top fold line 16 and bending of the side panel 17 about the top fold line 18.

As shown in FIGS. 3 and 4, a pair of longitudinal tightening or squeeze rails 38 and 39 is spaced slightly from the plows 33 and 34. The spacing is such that the advancing ends of the side panels 15 and 17 of the blank 12 enter between the squeeze rails 38 and 39 prior to the rear end of the blank 12 ceasing to be restrained. As shown in FIG. 3, the squeeze rails 38 and 39 have curved leading edges 40 and 41, respectively, at the entrance therebetween. The curved edges 40 and 41 guide the side panels 15 and 17 of the blank 12 into engagement with the sides of the cans 11, as shown in FIG. 6.

This engagement of the side panels 15 and 17 of the blank 12 with the sides of the cans 11 occurs when the curved edge 40 (see FIG. 3) terminates in a straight longitudinal edge 42 and the curved edge 41 terminates in a straight longitudinal edge 43. When the side panels 15 (see FIG. 6) and 17 are moved into engagement with the sides of the can 11, the top panel 14 has a right angle corner with the side panel 15 at the top fold line 16, and a right angle corner with the side panel 17 at the top fold line 18.

The straight longitudinal edges 42, 43 of the squeeze rails 38, 39 form the inner working edges of first portions 44, 46. As shown in FIG. 4, the first portions 44, 46 of the squeeze rails 38, 39 are disposed in a horizontal plane above a horizontal plane containing the second portions 45, 47 of the squeeze rails 38, 39 respectively.

The straight longitudinal edge 42 of portions 44, 45 feed into an angled edge 48 having a straight longitudinal edge 49 extending therefrom. The edges 48 and 49 of the squeeze rail 38 constitute the squeeze action part of the squeeze rail 38.

The straight longitudinal edge 43 of portions 46, 47 terminate in an inclined or angled edge 50 from which extends a straight longitudinal edge 50'. The edges 50 and 50' constitute the remaining part of the squeeze rail 39.

When the curved surfaces 40 and 41 of the squeeze rails 38 and 39, respectively, transform into the straight longitudinal edges 42 and 43, the tabs 25, 27 are captured and the side panels 15 and 17 of the blank 12 are urged into engagement with the sides of the caps 11, as shown in FIG. 6. As shown in FIGS. 4 and 5, a bottom plow 51 is disposed beneath the squeeze rail 38, and a bottom plow 52 is disposed beneath the squeeze rail 39.

The plow 51 has its front edge 53 spaced slightly exterior or outside of the inner longitudinal edge 42. Similarly, the plow 52 has its front edge 54 spaced slightly exterior or outside of the straight longitudinal edge 43 of the squeeze rail 39. Thus, the transverse spacing between the front edges 53 and 54 of the plows 51 and 52, respectively, is greater than the distance between the side panels 15 and 17 when the side panels 15 and 17 are engaging the sides of the cans 11, as shown in FIG. 6.

As a result, the bottom panels 19 and 22 enter between the plows 51 and 52. This causes the bottom panel 19 to ride along upper curved edge 55 (see FIGS. 4 and 5) of an inner curved portion 56 (see FIG. 5) of the plow 51 and the bottom panel 22 to ride along an upper curved edge 57 of an inner curved portion 58 of the plow 51.

Figure 2:
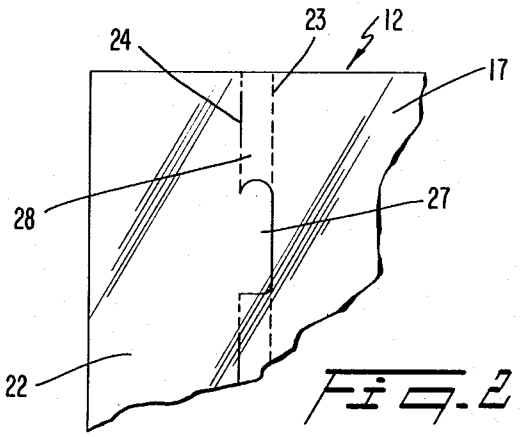
FIG. 2 is an enlarged fragmentary plan view of a portion of the blank of FIG. 1 and showing the two score lines formed between one of the side panels of the blank and a bottom or closure panel of the blank.
Figure 1:
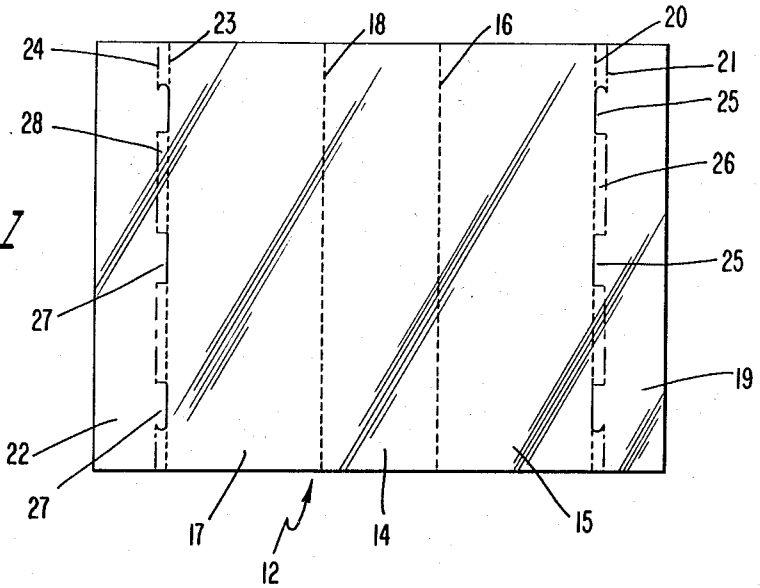
FIG. 1 is a top plan view of an elongated blank from which an article wrapper of the present invention is formed.

The edges of inner curved portions 56 and 58 of the plows 51 and 52, respectively, cause the bottom panels 19, 22 to bend about the score lines 21, 24 (see FIGS. 1 and 6). It should be observed from FIG. 6 that the upper edge 59 of the straight longitudinal portion 60 of the plow 51 is closer to the conveyor 30 than the upper edge 61 of the straight longitudinal portion 62 of the plow 52. This is because one bottom panel 19 must have its end above the end of the bottom panel 22 to enable the bottom panels 19 and 22 to overlap.

The swinging of the side panels 15 and 17 about the fold lines 16 and 18, respectively, into engagement with the sides of the cans 11 is indicated by curved arrows 63 in FIG. 6. The movement of the bottom panels 19 and 22 about the score lines 21 (see FIG. 1) and 24, respectively, is indicated in FIG. 6 by arrows 64.

When the bottom panel 19 is moved by the plow 51 about the score line 21 (see FIG. 1), the compression tabs 25 are captured and disposed in engagement with the edge and bottom surface of the first portion 44 of the squeeze rail 38 shown in FIG. 6. Similarly, the compression tabs 27 are captured and disposed in engagement with the edge and bottom surface of the first portion 46 of the squeeze rail 39. This is because the score lines 21 (see FIG. 1) and 24 are weaker than the score lines 20 and 23, respectively. Thus, the engagement of the tabs 25 and 27 with the bottom surfaces of the portions 44 and 46, respectively, of the squeeze rails 38 and 39, respectively, functions as pivots for the bottom panels 19 and 22.

As the blank 12 is advanced in the direction of the arrows 32 in FIG. 4, the squeeze rail 38 has an inclined connecting portion 65 between the first portion 44 and the second portion 45. This assists the bottom panel 19 in pivoting upwardly towards the bottoms of the cans 11. The squeeze rail 39 has an inclined connecting portion 66 (see FIG. 3) between the first portion 46 and the second portion 47 and configured in the same manner as the inclined connecting portion 65 of the squeeze rail 38. This assists the bottom panel 22 (see FIG. 7) to be moved upwardly towards the bottom panel 19.

As shown in FIG. 4, the straight longitudinal portion 60 of the plow 51 has an inclined upper edge 67 connecting the upper edge 59 of the plow 51 with an upper horizontal edge 68. The horizontal longitudinal portion 62 (see FIG. 3) of the plow 52 has a similar inclined upper edge 69 which is the same configuration.

With the conveyor 30 (see FIG. 4) ceasing to support the cans 11 at the end of the inclined connecting portion 65 of the squeeze rail 38 and the inclined connecting portion 66 (see FIG. 3) of the squeeze rail 39, the bottom panel 19 (see FIG. 7) is moved into abutting engagement with the bottoms of the cans 11 and the bottom panel 22 moved into overlapping relation with the bottom panel 19.

With the tabs 25 and 27 disposed beneath the bottom surfaces of the second portions 45 and 47, respectively, of the squeeze rails 38 and 39, respectively, as shown in FIG. 7, the straight longitudinal edges 42, 43 of the squeeze rails 38, 39 act against the blank 12 between the score lines 20 (see FIG. 1) and 21, 23 and 24.

As the blank 12 advances, the angled squeeze edge 48 (see FIG. 3) of the second portion 45 tightens (see FIG. 8) the blank 12 between the score lines 20 (see FIG. 1) and 21. The angled squeeze edge 50 of the second portion 47 similarly tightens the blank 12 between the score lines 23 (see FIG. 1) and 24. By the time that the blank 12 exits from the space between the squeeze edges 48, 50 (see FIG. 3), the side panels 15 and 17 have been pulled downwardly in the direction of arrows 71 of FIG. 9 so that the top panel 14 of the blank 12 engages the top of each of the cans 11 within the wrapper 10.

As the blank 12 continues advancing between the straight longitudinal edges 49, 50' (see FIG. 3) of the squeeze rails 38, 39, the article wrapper 10 is secured together in the position of FIG. 9. The bottom panels 19 and 22 are secured to each other by suitable means, such as an adhesive. Any other suitable means for attaching the bottom panels 19 and 22 to each other may be utilized including a thread and punch locking type of arrangement, for example.

As shown in FIG. 9, the side panel 15 has a right angle corner with the bottom panel 19 and the side panel 17 has a right angle corner with the bottom panel 22. The right angle corner between the side panel 15 and the bottom panel 19 is defined by the score line 20 (see FIGS. 1, 9 and 10), and the right angle corner between the side panel 17 and the bottom panel 22 is defined by the score line 23.

As shown in FIGS. 9 and 10, the compression tabs 25 and 27 of the blank 12 are completely hidden from view when the bottom panels 19 and 22 are secured to each other. Therefore, sides are uninterrupted and aesthetically pleasing and the tabs 25 and 27 cannot accidentally engage another of the article wrappers 10 or the like.

Furthermore, because of the upper surfaces 68 and 70 of the plows 51 and 52, respectively, acting on the tabs 25 and 27, the tabs 25 and 27 are returned into the planes of the bottom panels 19 and 22, respectively. Thus, the tabs 25 and 27 seal the package and remain engaged in the bottom.

Because the tabs 25 and 27 are completely flush in the article wrapper 10 even the bottom has an aesthetically pleasing appearance, and can provide another full panel for multi-color printing and graphics.

For purposes of exemplification, a particular embodiment of the invention has been shown and described according to the best present understanding thereof. However, it will be apparent that changes and modifications in the arrangement and construction of the parts thereof may be resorted to without departing from the spirit and scope of the invention.

What is claimed is:

1. An article wrapper for wrapping around an article or articles comprising an elongated blank having a top portion, side panels, fold means between said side panels and said top portion to connect them to each other, a pair of bottom panels, a pair of score lines between each of said bottom panels and the side panel to which said bottom panel is connected, a plurality of tabs formed between each pair of said score lines, and each of said tabs having its base connected to said score line farthest from said side panel to which said bottom panel is connected so that said tabs are not viewable when said blank is wrapped around the article.

2. The wrapper according to claim 1 in which said score line farthest from said side panel to which said bottom panel is connected is initially more weakened than said score line closest to said side panel to which said bottom panel is connected.

3. The wrapper according to claim 2 wherein said top portion includes a top panel and said fold means includes a fold line between each side panel and said top panel.

4. A method of forming an article wrapper from an elongated blank in which the article wrapper is wrapped around an article or articles including forming the blank with a top portion, side panels connected to the opposite sides of the top portion, fold means between each of the side panels and the top portion, a bottom panel connected to each of the side panels, and a pair of score lines between each of the side panels and the connected bottom panel, compression tabs for tightening the wrapper defined between said fold lines, positioning the blank substantially horizontal above the article to be wrapped, bending the side panels about the fold means, and bending and moving the bottom panels relative to the side panels about the two score lines to dispose each of the side panels with an angled corner with the connected bottom panel and the edge of the corner being defined by the score line closest to the side panel so as to maintain the side panels uninterrupted and the tabs hidden on the bottom of the wrapper.

5. The method according to claim 4 including bending each of the bottom panels initially about the score line farthest from the connected side panel and moving the bottom panels towards each other after the initial bending to cause bending of each of the bottom panels about the score line closest to the side panel, the corner being defined by the score line closest to the side panel.

6. The method according to claim 5 including engaging the panel section of each of the bottom panels between the pair of score lines with squeeze guides to move the bottom panels towards each other after the initial bending of each of the bottom panels so as to cause bending of each of the bottom panels about the score line closest to the side panel.

7. The method according to claim 6 including providing a top panel, bending the side panels about separate fold lines of said fold means so that each of the side panels is substantially perpendicular to the top panel.

8. The method according to claim 7 including moving the top panel into engagement with a portion of the article during the movement of the bottom panels towards each other.

* * * * *